US008349406B2

(12) United States Patent
Wei et al.

(10) Patent No.: US 8,349,406 B2
(45) Date of Patent: Jan. 8, 2013

(54) PROCESSES FOR FORMING COATED ABRASIVE PRODUCTS

(75) Inventors: Paul Wei, Tonawanda, NY (US); Gwo Swei, Vandalia, OH (US); Damien Nevoret, Worcester, MA (US); Wenliang Patrick Yang, Ballston Lake, NY (US)

(73) Assignee: Saint-Gobain Abrasives, Inc., Worcester, MA (US)

( * ) Notice: Subject to any disclaimer, the term of this patent is extended or adjusted under 35 U.S.C. 154(b) by 611 days.

(21) Appl. No.: 11/513,696

(22) Filed: Aug. 31, 2006

(65) Prior Publication Data

US 2006/0288649 A1 Dec. 28, 2006

Related U.S. Application Data

(62) Division of application No. 10/809,197, filed on Mar. 25, 2004, now abandoned.

(51) Int. Cl.
*B05D 3/02* (2006.01)

(52) U.S. Cl. ..... 427/376.1

(58) Field of Classification Search ..... 427/376.1
See application file for complete search history.

(56) References Cited

U.S. PATENT DOCUMENTS

| | | | | |
|---|---|---|---|---|
| 4,927,431 | A * | 5/1990 | Buchanan et al. | 51/298 |
| 5,014,468 | A | 5/1991 | Ravipati et al. | |
| 5,551,960 | A | 9/1996 | Christianson | |
| 5,571,297 | A | 11/1996 | Swei et al. | |
| 5,681,361 | A * | 10/1997 | Sanders, Jr. | 51/295 |
| 5,700,302 | A | 12/1997 | Stoetzel et al. | |
| 5,730,764 | A | 3/1998 | Williamson et al. | |
| 5,833,724 | A | 11/1998 | Wei et al. | |
| 5,855,632 | A | 1/1999 | Stoetzel et al. | |
| 5,863,306 | A | 1/1999 | Wei et al. | |
| 5,876,470 | A | 3/1999 | Abrahamson | |
| 5,928,394 | A | 7/1999 | Stoetzel | |
| 6,139,594 | A | 10/2000 | Kincaid et al. | |
| 6,187,070 | B1 | 2/2001 | Gaeta et al. | |
| 6,228,133 | B1 | 5/2001 | Thurber et al. | |
| 6,312,484 | B1 | 11/2001 | Chou et al. | |
| 6,413,286 | B1 * | 7/2002 | Swei et al. | 51/298 |
| 2003/0017797 | A1 | 1/2003 | Kendall et al. | |
| 2003/0022604 | A1 | 1/2003 | Annen et al. | |
| 2003/0121212 | A1 | 7/2003 | Minick et al. | |
| 2003/0143938 | A1 | 7/2003 | Braunschweig et al. | |
| 2003/0150169 | A1 | 8/2003 | Annen | |

FOREIGN PATENT DOCUMENTS

| | | |
|---|---|---|
| JP | 02256467 | 10/1990 |
| JP | 2003048167 | 2/2003 |

* cited by examiner

*Primary Examiner* — Nathan Empie
(74) *Attorney, Agent, or Firm* — Joseph P. Sullivan; Abel Law Group, LLP

(57) ABSTRACT

A coated abrasive product is disclosed, which includes a substrate and an abrasive layer overlying the substrate. The abrasive layer includes abrasive grains and a binder, the binder being formed from a binder formulation having first and second binder components mixed together uniformly with the abrasive grains, wherein the first binder component is radiation curable and the second binder component comprises a powder and is thermally curable.

20 Claims, 3 Drawing Sheets

PROCESSES FOR FORMING COATED ABRASIVE PRODUCTS

CROSS-REFERENCE TO RELATED APPLICATION(S)

The present application is a divisional application of U.S. application Ser. No. 10/809,197, filed Mar. 25, 2004 now abandoned, entitled "COATED ABRASIVE PRODUCTS AND PROCESSES FOR FORMING SAME" and naming inventors Paul Wei; Gwo Swel, Damien Nevoret and Wenliang Patrick Yang, which is incorporated herein by reference in its entirety.

BACKGROUND

1. Field of the Invention

The present invention is generally directed to coated abrasive products, and in particular coated abrasive products and processes for forming same that employ a binder formulation having multiple pathways for curing.

2. Description of the Related Art

Coated abrasive products fundamentally include a substrate or backing member that serves as a dimensionally stable component, on which an abrasive-containing layer is deposited. In traditional coated abrasives, abrasive grains of the abrasive layer are adhered to the backing member through use of a maker coat, which is an adhesive binder composition for anchoring the as-deposited abrasive grains. Most typically, processing continues with deposition of a size coat that lends structural integrity to the abrasive layer. In the context of traditional coated abrasives, the abrasive grains are generally randomly oriented and form a fairly uniform layer.

Engineered or structured abrasives have been developed to provide improved performance over traditional coated abrasive products. Structured abrasives also generally utilize a backing member, but the abrasive layer is deposited in order to form a pre-configured pattern. Such structured abrasives generally exhibit enhanced grinding characteristics over conventional abrasive products, such as providing sustained cut rate, consistent surface finish, and extended life.

In the context of both traditional coated abrasives and structured abrasives, thermal curable binders have been used to adhere the abrasive layer to the backing member or substrate, as well as to stabilize the abrasive grains. However, thermal curing suffers from numerous drawbacks including, often times, extended cure times resulting in unwanted shifting of abrasive grain position. Particularly in the context of structured abrasives, the pattern of grains may be disrupted during rheological changes of the binder formulation during heating and/or during handling of the structured abrasive prior to or during heat treatment.

In an effort to address such disadvantages, so-called radiation-curable binder systems have been developed, which advantageously permit short curing cycles. Such radiation curable binders include UV-curable binders as well as e-beam curable binders. However, radiation curable binders are not without their drawbacks as well. For example, particularly in the case of silicon carbide-based abrasives, the depth of penetration of the radiation is limited. Further, dyes present within the binder formulation can cause issues with radiation penetration as well, resulting in incomplete curing.

In an effort to address the processing and performance characteristics associated with known coated abrasives, and in particular structured abrasives, U.S. Pat. Nos. 5,863,306 and 5,833,724 describe various coated abrasives formed utilizing a binder formulation that combines radiation curable and thermally curable components. During processing, viscosity is modified through use a functional powder that is added to a coated intermediate product prior to curing. The functional powder is intended to adjust a viscosity of the intermediate product, to retain structural integrity during processing such that its engineered shape is maintained prior to and during curing.

Despite advances provided in the art, as exemplified in the '306 and '724 patents for example, a need continues to exist for superior coated abrasives and methods for forming same, and which further lend themselves to large-scale manufacturing operations.

SUMMARY

According to a first embodiment, a coated abrasive product includes a substrate, and an abrasive layer overlying the substrate. The abrasive layer includes abrasive grains and a binder, the binder being formed from a binder formulation including first and second binder compounds mixed together uniformly with the abrasive grains. The first binder compound is generally radiation curable, and the second binder compound is desirably in powder form, and is thermally curable.

According to another embodiment, a method of forming a coated abrasive product, includes mixing a binder formulation with abrasive grains to form an abrasive dispersion, the binder formulation including a mixture of first and second binder compounds. The first binder compound is radiation curable, and the second binder compound is generally in powder form, and is thermally curable. The process continues with coating a substrate with the abrasive dispersion to form a coated intermediate product, and carrying out curing operations. Curing is carried out by irradiating the coated intermediate product to cure the first binder compound, and thermally treating the coated intermediate product to cure the second binder compound.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE EMBODIMENTS

Figure 1:
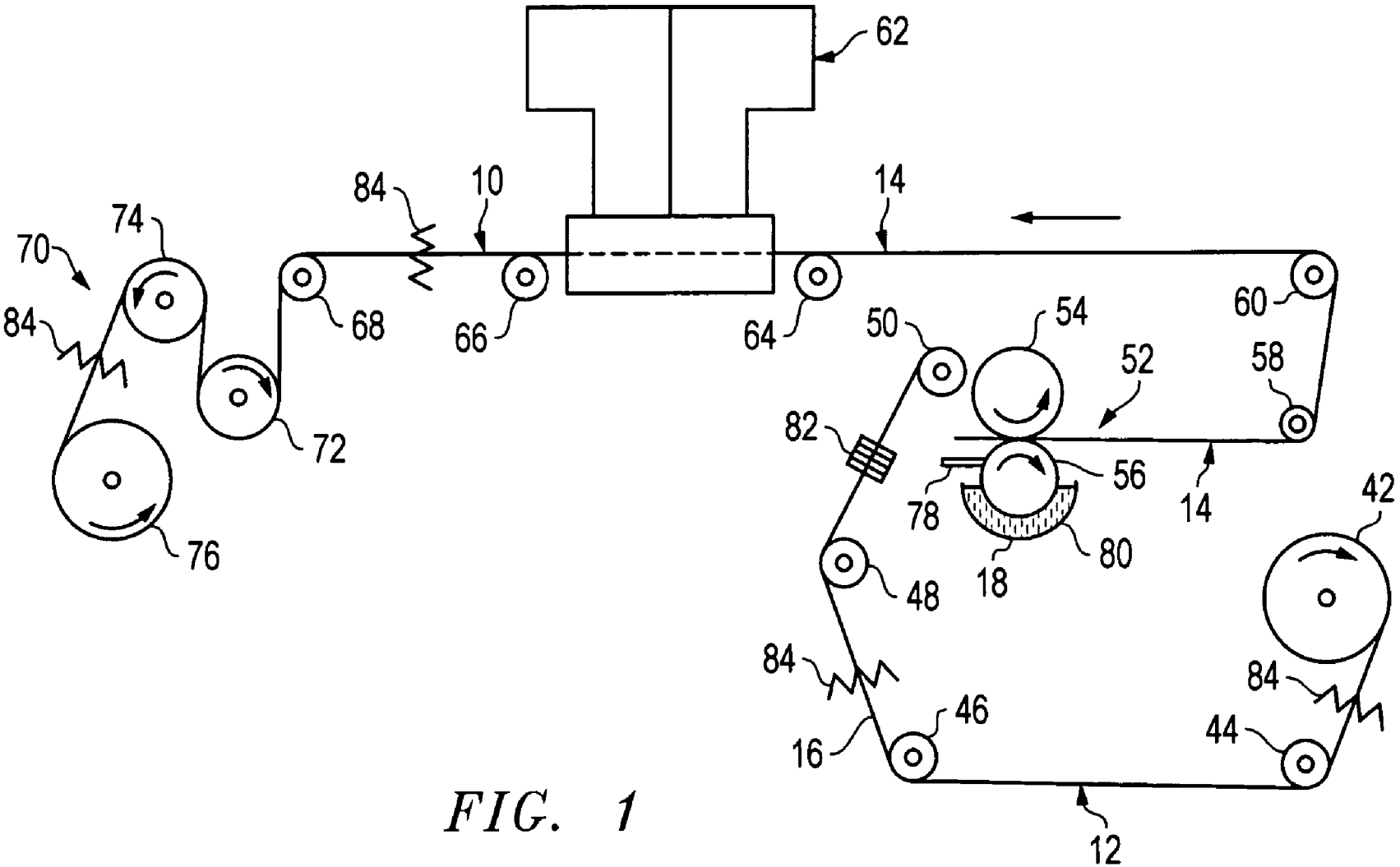
FIG. 1 illustrates a basic schematic layout and process flow for forming a structured coated abrasive product according to an embodiment of the present invention.

According to an aspect of the present invention, a coated abrasive product is provided, including generally a substrate and an abrasive layer overlying the substrate. The abrasive layer includes abrasive grains and a binder, the binder being formed from a binder formulation. In a particular embodiment, the binder formulation includes first and second binder compounds that are mixed together uniformly with the abrasive grains. Typically, the first binder is radiation curable, and the second binder is formed of a powder, and is thermally curable. Each of the first and second binders may have only a single pathway for curing. That is, each binder may be mono-curable, such that only a single curing methodology can be used to cure the particular binder compound. For example, as noted above, the first binder may be mono-curable such that it is only curable by irradiation, while the second binder is mono-curable, curable only by thermal treatment.

Turning to the particularities of the binder formulation, as noted above, one of the binder compounds is generally radiation curable, such as UV-curable, e-beam curable, or microwave curable. A particularly useful UV-binder composition contains constituents chosen from the group of acrylate and methacrylate oligomers and monomers. Useful oligomers include epoxy acrylates, aliphatic urethane acrylates, aromatic urethane acrylates, polyester acrylates, aromatic acid acrylates, epoxy methacrylates, and aromatic acid methacrylates. Monomers include mono-, di-, tri-, tetra-, and pentafunctional acrylates and methacrylates, such as trimethylopropane triacrylate, trimethylolpropane triacrylate, tris(2-hydroxy ethyl)isocyanuarate triacrylate, tripropylene glycol diacrylate, hexanediol diacrylate, octyl acrylate, octyl acrylate, and decyl acrylate. The binder formulation may include substantial amounts of acrylate monomers containing 3 or more acrylate groups per molecule. Typically commercial products include, trimethylopropane triacrylate, (TMPTA) as noted above, as well a pentaerythritol triacrylate (PETA). The relative amounts of di- and tri-functional acrylates as well as higher molecular weight acrylate oligomers may be adjusted along with the other components to give proper rheological properties for processing and proper toughness and cutting characteristics of the end product after cure.

Further, coupling agents may be utilized to improve the bonding between the adhesive and the abrasive grains. Typical coupling agents include organosilanes, for example A174 and A-1100 available from Osi Specialties, Inc., and organotitanates and zircoaluminates. A particular group of coupling agents includes amino silanes and methacryloxy silanes.

Fillers can be incorporated into the dispersion to modify the rheology of the dispersion and the hardness and toughness of the cured binders. Examples of useful fillers include: metal carbonates such as calcium carbonate, sodium carbonate; silicas such as quartz, glass beads, glass bubbles; silicates such as talc, clays, calcium metasilicate; metal sulfate such as barium sulfate, calcium sulfate, aluminum sulfate; metal oxides such as calcium oxide, aluminum oxide (such as in the form of boehmite and/or pseudo-boehmite); and aluminum trihydrate.

The dispersion may comprise a grinding aid to increase the grinding efficiency and cut rate. Useful grinding aids can be inorganic based, such as halide salts, for example sodium cryolite, potassium tetrafluoroborate, etc.; or organic based, such as chlorinated waxes, for example polyvinyl chloride. A particular embodiment includes cryolite and potassium tetrafluoroborate with particle size ranging from 1 to 80 micron, and most preferably from 5 to 30 micron. The weight percent of grinding aid ranges from 0 to 50%, and most preferably from 10-30% of the entire formulation (including the abrasive components).

In addition to the above constituents, other components may also be added: typically a photoinitiator such as a benzoin ether, benzil ketal, α-alkoxy-acetonphenone, α-hydroxy-alkylphenone, α-amino alkylphenone, acyl phosphine oxide, benzophenone/amine, thioxanthone/amine, or another free radical generator; anti-static agents, such as graphite, carbon black, and the like; suspending agents, such as fumed silica; anti-loading agents, such as zinc stearate; lubricants such as wax; wetting agents; dyes; fillers; viscosity modifiers; dispersants; and defoamers.

Turning to the second binder compound, various thermal curable polymers may be utilized. While thermoplastic and thermoset polymers may be utilized, oftentimes thermoset polymers are emphasized due to their stable nature, particularly in the context of cutting or finishing operations that generate excessive heat. According to a particular development, the second binder compound is comprised of a powder, typically formed principally of powder or even essentially entirely powder. Generally, liquid thermally curable polymers are excluded in favor of the powder. Powder form thermal curable binders are particularly advantageous, as such may be incorporated into a process flow for forming coated abrasives fairly easily. Indeed, use of a powdered thermal-curable binder is particularly advantageous for creation of abrasive dispersions used for forming structured abrasives. Moreover, it has been found that use of thermal curable components in powder form have been demonstrated to provide improved abrasive performance in the end product, as well as providing abrasive dispersions that have improved processability due at least in part to beneficial changes in the viscosity of the dispersions. Examples of thermal curable polymers include epoxy resins, urethane resins, phenolic resins, urea/formaldehyde, melamine/formaldehyde, acrylic resins, polyester resins, vinyl, and mixtures thereof, provided that such resins are used in powder form rather than liquid form. It is understood that such resins are available in either form, and that powdered or particulate form is preferably used herein.

The abrasive grains may be formed of any one of or a combination of known abrasive grains, including alumina (fused or sintered), zirconia, zirconia/alumina oxides, silicon carbide, garnet, diamond, cubic boron nitride and combinations thereof. Particular embodiments have been created by use of dense abrasive grains comprised principally of alpha-alumina. The abrasive particles generally have an average particle size from 1 to 150 micron, and more typically from 1 to 80 micron. In general however the amount of abrasive present provides from about 10 to about 90%, such as from about 30 to about 80%, of the weight of the formulation.

The backing member may be formed of flexible but mechanically stable materials, including various polymer films, paper and other cellulosic materials, and fabrics including cotton and polyester with various polymeric saturants. A particular type of backing member or substrate is polyethylene terephthalate film. Other polymeric films include polycarbonate films. The backing members may be primed or pre-treated to promote adhesion between the abrasive layer and the backing member. Details of the radiation-curable binder component, additives with respect thereto, the backing member, and the abrasive grains may be found in U.S. Pat. No. 5,014,468, commonly owned by the present Assignee, incorporated herein by reference.

Turning to a particular aspect of the present invention, the following description focuses on structured abrasives, generally having a raised pattern of abrasive material, as well as methods for manufacturing same.

FIG. 1 illustrates a basic process flow for continuous manufacture of a coated abrasive product 10, and in particular, a structured or engineered coated abrasive product. Here, a backing member 12 is withdrawn from a roll 42 provided on an unwind stand. The unwind stand is fitted with a brake, according to usual practice, to give a desired resistance to unwinding of the backing member. The backing member 12 travels from the unwind area around one or more suitable rolls designated by reference numerals 44, 46, 48 and 50, and to the coating area denoted generally by reference numeral 52, where it is passed between the nip formed by roll 54 and patterned roll 56, rotating in the directions indicated by the arrows. The patterned roll is one type of tool to impart 3-dimensional structures that may be used according to embodiments of the present invention. The backing member 12 with the abrasive coating 14 coated thereon is passed around one or more rolls 58, 60 to a curing station 62 having a radiation source, such as and e-beam source or actinic light source, i.e., ultraviolet (UV) light source, for curing a portion of the binder formulation. The curing station 62 may further include a thermal source downstream of the UV light source, to complete curing of the product. Alternatively, the thermal source may be provided off-line. For example, following a partial cure utilizing only radiation, the thus partially cured product may be rolled and cured in rolled form in a thermal cure oven (bulk curing), or may be routed through another reel-to-reel process containing a thermal cure station (linear, or in-line curing). According to one aspect, use of a first binder compound that permits quick, in-line curing, later stage curing can take place off-line in a bulk curing operation, while still maintaining the desired structural features of the adhesive layer.

Rolls 64, 66 route the coated abrasive material 10 to travel in horizontal disposition through the curing zone. From the curing zone, the coated abrasive material 10 travels over roll 68 to a conventional takedown assembly denoted generally by reference numeral 70 and which includes roll 72, a rubber-covered roll 74, and compressed air driven takedown roll 76 to provide a wound roll of coated abrasive material.

The radiant power of the source of actinic light can be provided by any conventional UV source. For example, in the practice of the invention, the coatings were exposed to UV light generated from V, D, H, or H+ bulbs, or a combination thereof at an energy output ranging from 100 watts per inch of width to 600 watts per inch of width.

The pattern formed on the backing member through contact with the patterned roll can comprise isolated islands of formulation, or a pattern of ridges separated by valleys. The patterns are generally designed to provide an abrasive product with a plurality of grinding surfaces equidistant from the backing with the area of grinding surface increasing with erosion of the layer. Between the grinding surfaces, channels are often provided to allow circulation of grinding fluids and removal of swarf generated by the grinding.

In addition, the tool used to pattern and deposit the abrasive composition, can be heated or chilled so as to contribute to the raising of the viscosity to render the formulation surface plastic but non-flowing. The heating however, should not be to such a level that the binder cures while in contact with the tooling. By adjusting the viscosity of the resin formulation or the surface layer, the pattern is substantially retained to enable curing and handling, such as for at least about 30 seconds and preferably at least 60 seconds.

While the foregoing embodiment has been described specifically in connection with use of a patterned roll, other patterning techniques may be used. In a relatively simple form, an appropriate substrate may be coated with an abrasive formulation, and then patterned by contact with an embossing tool, such as a patterned stamp or knurled steel roll.

According to a particular development, the abrasive dispersion or composition makes use of a thermal cure polymer in powder form, combined the radiation cure polymer with an abrasive component, and additional components as detailed above. Typically, the particle size of the thermal cure polymer can range from sub-micron to 500 microns. Changing the particle size can be used to modify the rheological properties of the coating as well as the final mechanical properties. The incorporation of a binder resin in the form of a powder also permits processing of slurries with low abrasive, filler, and grinding aid content that would not be processable when made with a binder solely in liquid form.

Figure 2:
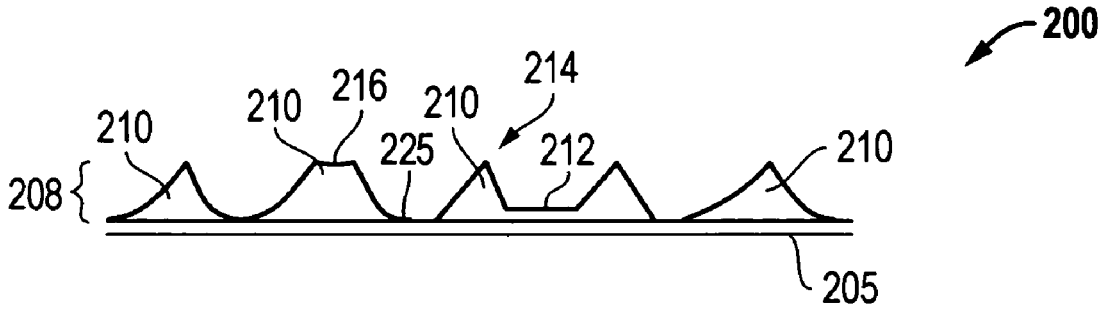
FIG. 2 illustrates a cross-sectional view of an embodiment of the present invention.

Turning to FIG. 2, a cross-sectional view of a structured abrasive embodiment is illustrated. In particular, structured abrasive product 200 includes a substrate or backing member 205 over which an abrasive layer 208 is provided. The abrasive layer 208 includes, in cross-section, raised features 210. The profile of raised features 210 may vary considerably based on the intended end use. In the embodiment shown, the features 210 have a generally sloping and triangular cross-section, terminating in a relative sharp peak 214 forming a cutting surface, and/or a flat cutting surface 216. The various features may be connected together through an underlying matrix 212, or may be spaced apart from each other by voids in abrasive material as illustrated by portion 225, generally exposing a portion of the backing member 205. As can be seen in perspective view, the structured abrasive has a generally repeating polygonal contiguous pattern. It is noted that portions of the pattern may be broken, forming only localized patterns of contiguous raised features.

Figure 3:
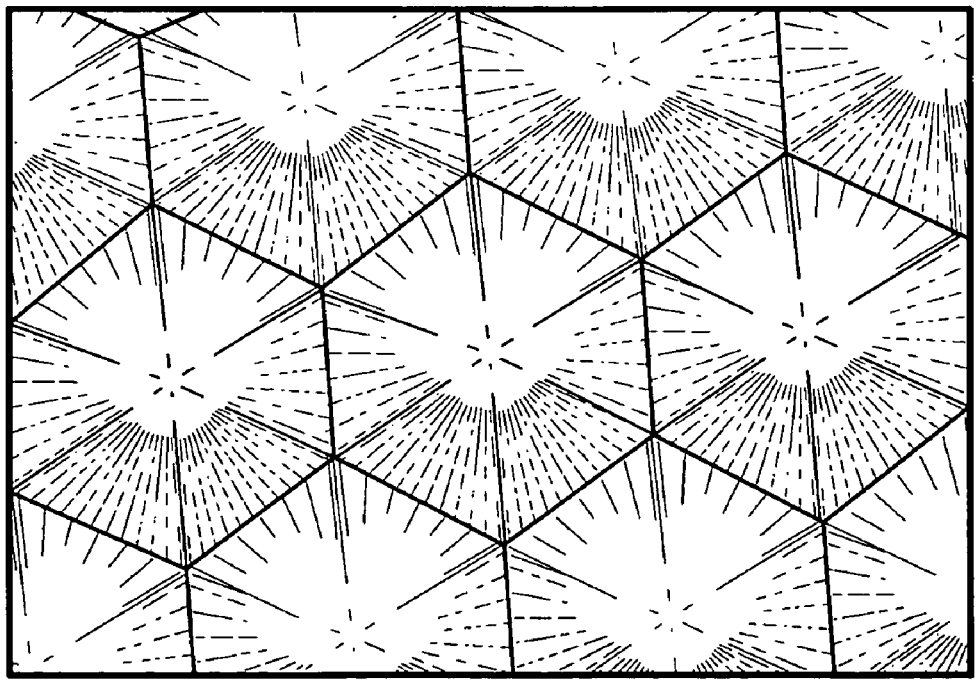
FIGS. 3-5 illustrate perspective views of several embodiments of the present invention.
Figure 4:
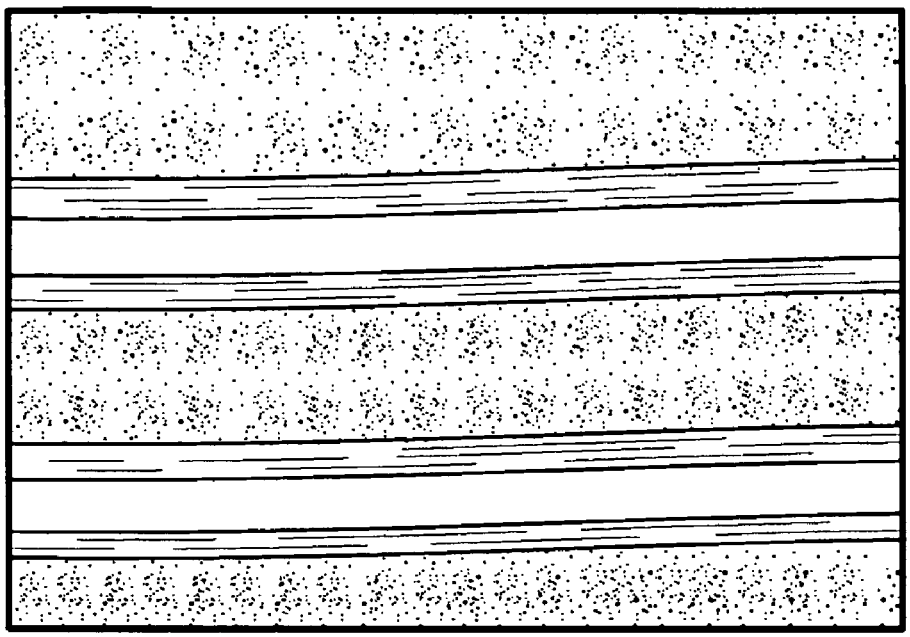
Figure 5:
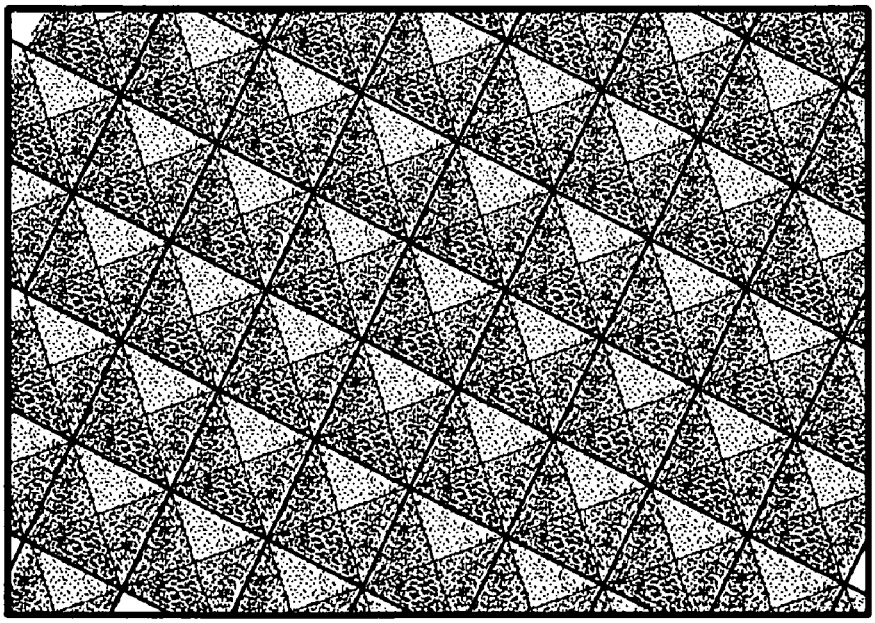

Turning to FIGS. 3-5, various embodiments of structured abrasives are disclosed. These figures represent graphical representations of actual SEM photos, showing, in an exemplary manner, several different geometric patterns. FIG. 3 shows hexagonally-shaped surface features arranged in an ordered array. FIG. 4 shows generally linear surface features having a fairly substantial aspect ratio, defined as the ratio of the length of the surface feature to the next largest dimension, here, the width. Aspect ratios of 10, 100, or even greater are typical. FIG. 5 shows an array of square surface features (in horizontal cross section). As shown, each surface feature forms a pyramid, having four major side surfaces terminating at a peak. The valleys between the surface features may be completely devoid of abrasive material, but in the embodiments shown, generally the valleys contain a comparatively thinner portion of the abrasive layer.

EXAMPLES

Example 1

Wet Centerless Grinding of Stainless Steel

Tested products: Novolac thermoset powder Varcum 29-345 from OxyChem was added into a control engineered abrasives formulation to evaluate the effect of the thermoset powder, providing the thermal curing functionality to the binder formulation, on the grinding performance in wet centerless grinding application. The modified and control formulations were coated on a polyester cloth substrate and processed under the same conditions to make engineered abrasive product, which included exposure to UV radiation in a Fusion UV unit. The Novolac containing product was further thermally cured at 250F for 3.5 hours. The formulations are listed in Table 1.

TABLE 1

| Component | Control Formulation | With Novolac powder |
|---|---|---|
| Ebecryl 3700 | 19.6 | 28 |
| TMPTA | 8.4 | 12 |
| Irgacure 819 | 1.2 | 1.7 |
| Varcum 29-345 | | 17.1 |
| ATH | 34.2 | 19.6 |
| A1100 | 1.2 | 1.2 |
| P320 aluminum oxide | 35.4 | 20.4 |
| Total | 100 | 100 |

The process flow for forming the embodiments herein is described in detail in U.S. Pat. No. 5,863,306, incorporated herein by reference.

Key: Ebecryl 3700: epoxy acrylate from UCB chemicals. TMPTA: trimethylol triacrylate from UCB chemicals. Irgacure 819: phosphine oxide photoinitiator from Ciba-Geigy. Varcum 29-345: Novolac powder from OxyChem. ATH-: aluminum trihydroxide from ALCOA with A1100 silane surface treatment. A1100: amino silane A1100 from Osi.

Testing Machine Tool: An ACME Model 47 constant-feed, centerless belt grinder was used for the entire testing procedure. The machine consists of four main components including the regulating wheel, work rest blade, contact wheel and abrasive belt.

Work Material: A set of 20 cylindrical, 304 stainless steel workpieces were used, each measuring 1.5 in.×10 in. at the start of testing.

Test Procedure: The products were flexed and converted to 4"×54" belts for testing on the centerless grinder. Prior to grinding any workpieces, the following parameters were verified on the machine tool:

Regulating wheel angle was set to 5°. Regulating and contact wheel spindles were confirmed parallel to one another. Regulating wheel and contact wheel were dressed. Nylon work rest was ground clean. Work guides were adjusted to allow for proper part clearance.

The test procedure followed the sequence of steps outlined below:

The workpieces were pre-ground to remove surface defects. The weight of each workpiece was recorded. The machine was adjusted for the desired infeed at 0.006 in and the regulating wheel speed was set at 53 RPM. Two bars were passed through the machine; this was counted as one pass. During grinding a water coolant containing a rust inhibitor was sprayed on the abrasive belt. The weight of each workpiece was recorded to calculate the metal removed. The belt thickness and belt stretch were measured. The infeed was then increased by an additional 0.006 in, two more bars were sent through the machine, and the weight, thickness, and stretch measurements were taken again. These steps were repeated until the product was worn down to the backing.

Test Results: The formulation with addition of Novolac powder exhibited improved wear resistance over the control formulation. It lasted for 5 passes compared to 4 for the control formulation. With even a lower abrasive grain content than the control, the product with Novolac powder (or similar phenol/formaldehyde based powders) attained higher stock removal than the control formulation. Furthermore, the cut to wear ratio for product with Novolac powder is significantly better than the control product.

TABLE 2

| Pass | Cumulative Cut (g) | Wear (in) | Cut/Wear Ratio |
|---|---|---|---|
| Control Formulation | | | |
| 1 | 8.77 | 0.007 | 125 |
| 2 | 19.49 | 0.010 | 195 |
| 3 | 32.91 | 0.014 | 235 |
| 4 | 46.32 | 0.016 | 289 |
| 5 | worn down to backing | | |
| With Novolac Powder | | | |
| 1 | 9.91 | 0.007 | 142 |
| 2 | 21.24 | 0.010 | 212 |
| 3 | 35.13 | 0.012 | 293 |
| 4 | 50.83 | 0.015 | 339 |
| 5 | 63.09 | 0.016 | 394 |

Example 2

Composite Sanding Discs

Test Products: Products in two grit sizes were tested: 9 micron and 30 micron. For each grit size, a control formulation with a binder consisting only of UV-curable resin was made, and a modified formulation containing an acrylic-based thermoset powder in addition to the UV-curable resin was made. The modified and control formulations were coated on a polyethylene terephthalate film substrate and processed under the same conditions to make engineered abrasive product, which included exposure to UV radiation in a Fusion UV unit. The products with thermoset powder received additional thermal cure at 250° F. for 4 hours.

TABLE 3

| 9 micron control formulation | |
|---|---|
| Slurry Component | Mass % |
| TMPTA | 15.6 |
| Ebecryl 3720 | 6.7 |
| SR504 | 5.6 |
| Irgacure 819 | 1.2 |
| A1100 | 1.2 |
| $KBF_4$ | 31.4 |
| ATH | 6.9 |
| 9 micron aluminum oxide | 31.4 |
| Total | 100.0 |

TABLE 4

| 9 micron with thermoset powder | |
|---|---|
| Slurry Component | Mass % |
| TMPTA | 19.8 |
| Ebecryl 3720 | 36.8 |
| BYK A501 | 0.1 |
| Irgacure 819 | 2.1 |
| A1100 | 2.1 |
| Acrylic thermoset powder | 32.1 |
| 9 micron aluminum oxide | 7.0 |
| Total | 100.0 |

TABLE 5

| 30 micron control formulation | |
|---|---|
| Slurry Component | Mass % |
| TMPTA | 21.0 |
| Ebecryl 3720 | 9.0 |
| Irgacure 819 | 1.2 |
| A1100 | 1.2 |
| $KBF_4$ | 33.8 |
| 30 micron aluminum oxide | 33.8 |
| Total | 100.0 |

TABLE 6

| 30 micron with thermoset powder | |
|---|---|
| Slurry Component | Mass % |
| TMPTA | 11.6 |
| Ebecryl 3720 | 34.9 |
| BYK A501 | 0.1 |
| Irgacure 819 | 2.2 |
| A1100 | 2.0 |
| Acrylic thermoset powder | 22.1 |
| 30 micron aluminum oxide | 27.1 |
| Total | 100.0 |

Key:
Ebecryl 3720: epoxy acrylate from UCB chemicals.
TMPTA: trimethylol triacrylate from UCB chemicals.
Irgacure 819: phosphine oxide photoinitiator from Ciba-Geigy.
BYK A501: defoamer from BYK Chemie.
A1100: amino silane A1100 from Osi. .
Acrylic thermoset powder: 158C121 from VEDOC powder coatings of Ferro. .

Work Materials: 6"×24"×½" composite panels were used for testing.

Equipment: Products were tested on an automated sanding machine designed to test discs for random orbital sanders. The machine consists of a random orbital sander from Dynabrade mounted on an arm that reciprocates at a set stroke length. The machine works by starting the disc, lowering the arm to place the sander against the workpiece, moving the sander back and forth on the workpiece at a set pressure and for a set amount of time, and then raising the sander away from the workpiece. Measurements are then performed on the workpiece. A balance is used to measure its weight; a surface analyzer is used to measure the surface finish; and a glossmeter is used to measure the gloss.

Test Procedure: A composite panel was cleaned and wiped dry, and its weight was recorded. The stroke length of the machine was set to 20 inches and the downward force on the abrasive disc was set to 10 pounds. The panel was placed in the sanding machine and the machine was run for 1 minute. The traverse speed of the sander across the workpiece was approximately 20 ft/min. Water was misted onto the surface of the solid surface panel using a spray bottle during the sanding test. After one minute of sanding on the machine, the panel was removed from the machine, cleaned with water, and wiped dry. The panel was weighed and the weight loss recorded. A surface analyzer was used to record Ra, Ry, and Rmax. A gloss meter was used to record gloss reading at 20, 60 and 85 degrees. The panel was again placed into the sanding machine, sanded for one minute, cleaned, and measured. This procedure was repeated until 12 minutes of sanding had been performed on the panel.

Test Results:

The grinding results are summarized in Table 7. The formulations with thermoset powder had significantly better wear resistance over the control formulations. The weight loss of both the 9 micron and 30 micron formulations with thermoset powder after 12 minutes of wet sanding was only 0.1 gram compared to 7.4 and 10.6 grams, respectively, for the control counterparts. The G ratio, defined as the ratio of stock removal to product weight loss, is also substantially improved for formulations with thermoset powder (125 and 43 versus 0.54 and 0.77). In addition, the products with thermoset powders attained much higher final gloss values than the control formulations on the polished solid surfaces, which is a critical performance criterion for this application. In summary, the addition of plastic powder improved the wear resistance, G ratio, and final gloss values of the polished solid surfaces by a surprisingly considerable amount.

TABLE 7

| | Stock Removal (g) | Product Weight Loss (g) | G Ratio | Gloss 20° | Gloss 60° | Gloss 85° |
|---|---|---|---|---|---|---|
| 30 micron control | 5.74 | 10.6 | 0.54 | 0.3 | 2.9 | 15.9 |
| 30 micron with powder | 12.5 | 0.1 | 125 | 1.2 | 9.2 | 62.6 |
| 9 micron control | 5.72 | 7.4 | 0.77 | 1.1 | 9.5 | 51.0 |
| 9 micron with powder | 4.27 | 0.1 | 43 | 5.6 | 25.1 | 90.4 |

According to embodiments disclosed above, coated abrasives, and in particular structured or engineered coated abrasives are disclosed having a particular binder formulation which not only improves processability, but also manifests in notable performance characteristics as summarized above. In addition, use of first and second distinct binder compounds as described in connection with various embodiments disclosed above, permits a great deal of flexibility in binder composition choice. In contrast, prior use of bi-functional compounds having different functional groups engineered into a single binder compound suffer from reduced process flexibility and are significantly more difficult to engineer and implement.

The above-disclosed subject matter is to be considered illustrative, and not restrictive, and the appended claims are intended to cover all such modifications, enhancements, and other embodiments, which fall within the scope of the present invention. Thus, to the maximum extent allowed by law, the scope of the present invention is to be determined by the broadest permissible interpretation of the following claims and their equivalents, and shall not be restricted or limited by the foregoing detailed description.

For example, while the foregoing makes specific reference to distinct binder compounds that are respectively radiation curable and thermal curable, the relatively quick-curing radiation curable binder may be replaced with alternative binders. For example, a quick curing epoxy capped catalyst that is quick cured by thermal treatment may be used. Alternatively, a quick curing urethane/blocked catalyst that is quick cured by thermal treatment may be used. In this regard, the first binder compound generally desirably maintains its quick cure properties, combined with the more robust, comparatively slower curing second binder compound.

What is claimed is:

1. A method of forming a coated abrasive product, comprising:

mixing a binder formulation with abrasive grains to form an abrasive dispersion, the binder formulation comprising a mixture of first and second binder components, wherein the first binder component is radiation curable and the second binder component comprises a powder and is thermally curable, the second binder included in an amount sufficient to modify the rheological properties of the binder formulation, wherein the first binder component an epoxy acrylate component, and wherein the second binder component is a phenolic resin, an acrylic resin, or polyester resin;

coating a substrate with the abrasive dispersion to form a coated intermediate product;

patterning the coated intermediate product;

irradiating the coated intermediate product to cure the first binder component following patterning; and thermally treating the coated intermediate product to cure the second binder component following patterning.

2. The method of claim 1, wherein the second binder component consists essentially of powder.

3. The method of claim 1, wherein coating and irradiating are carried out in a continuous process.

4. The method of claim 3, wherein thermally treating is carried out in the continuous process.

5. The method of claim 3, wherein the continuous process is a spool to spool process, in which the substrate is translated during at least the coating and irradiating steps.

6. The method of claim 3, wherein coating and patterning are carried out utilizing a tool to pattern the abrasive dispersion on the substrate.

7. The method of claim 3, wherein thermally treating is carried out off-line, the coated intermediate product being in wound form, and being bulk heated to effect curing of the second binder component.

8. The method of claim 1, wherein the coating and patterning are carried out such that the abrasive dispersion forms a pattern of abrasive structures.

9. The method of claim 1, wherein the first binder component is a UV curable component.

10. The method of claim 1, wherein the second binder component comprises a thermoset polymer.

11. The method of claim 1, wherein patterning the coated intermediate product includes contacting the coated intermediate product with an embossing tool.

12. The method of claim 1, wherein the first binder component is an epoxy acrylate component, and wherein the second binder component is a phenolic resin.

13. The method of claim 1, wherein the first binder component is an epoxy acrylate component, and wherein the second binder component is an acrylic resin.

14. The method of claim 1, wherein the first binder component is an epoxy acrylate component, and wherein the second binder component is a polyester resin.

15. A method of forming an engineered abrasive product, the method comprising:

mixing a binder formulation with abrasive grains to form an abrasive dispersion, the binder formulation comprising a mixture of first and second binder components, wherein the first binder component is UV curable and the second binder component comprises a thermally curable powder, the second binder included in an amount sufficient to modify the rheological properties of the binder formulation, wherein the first binder component is an epoxy acrylate component, and wherein the second binder component is a phenolic resin, an acrylic resin, or a polyester resin;

forming a coated intermediate product on a substrate with the abrasive dispersion, the coated intermediate product including a pattern of raised grinding surfaces;

patterning the coated intermediate product;

irradiating the coated intermediate product to cure the first binder component following patterning; and thermally treating the coated intermediate product after irradiating to cure the second binder component following patterning.

16. The method of claim 15, wherein patterning the coated intermediate product includes forming a pattern of raised grinding surfaces.

17. The method of claim 15, wherein patterning the coated intermediate product includes contacting the abrasive dispersion with an embossing tool after coating.

18. The method of claim 15, wherein forming the coated intermediate product, patterning the coated intermediate product, irradiating the coated intermediate product, and thermally treating the coated intermediate product are carried out in a continuous process.

19. The method of claim 15, further comprising winding the coated intermediate product following irradiating the coated intermediate product, wherein thermally treating the coated intermediate product includes bulk heating the wound coated intermediate product.

20. A method of forming an engineered abrasive product, the method comprising:

mixing a binder formulation with abrasive grains to form an abrasive dispersion, the binder formulation comprising a mixture of first and second binder components, wherein the first binder component is UV curable and the second binder component comprises a thermally curable powder, the second binder included in an amount sufficient to modify the rheological properties of the binder formulation, wherein the first binder component is an epoxy acrylate component, and wherein the second binder component is a phenolic resin, an acrylic resin, or a polyester resin;

coating a substrate with the abrasive dispersion to form a coated intermediate product;

contacting the coated intermediate product with an embossing tool to form at least a portion of the abrasive dispersion into a pattern of raised grinding surfaces;

irradiating the coated intermediate product to cure the first binder component following contacting the coated intermediate product with the embossing tool; and thermally treating the coated intermediate product to cure the second binder component after irradiating.

* * * * *